US007878873B1

(12) United States Patent
MacLeod

(10) Patent No.: US 7,878,873 B1
(45) Date of Patent: Feb. 1, 2011

(54) THRUST ADJUSTMENT APPARATUS FOR AN UNDERWATER VEHICLE

(75) Inventor: Robert Bruce MacLeod, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 07/599,571

(22) Filed: Oct. 17, 1990

(51) Int. Cl.
*B63H 1/18* (2006.01)

(52) U.S. Cl. ..... 440/66; 440/68; 114/338

(58) Field of Classification Search ..... 440/66, 440/68, 69, 70; 114/338, 20.1
See application file for complete search history.

(56) References Cited

U.S. PATENT DOCUMENTS 5,292,088 A * 3/1994 Lemont ..... 244/65
5,687,670 A * 11/1997 Rice, IV ..... 114/312
7,335,074 B2 * 2/2008 Arneson ..... 440/66

* cited by examiner

*Primary Examiner*—J. Woodrow Eldred
(74) *Attorney, Agent, or Firm*—James M. Kasischke; Michael P. Stanley; Jean-Paul A. Nasser

(57) ABSTRACT

An apparatus for providing thrust adjustment on an underwater vehicle with a propeller shroud is disclosed. A portion of the vehicles body is provided with a compliant surface such that expansion and contraction of the compliant surface affects the flow of water through a channel formed by the vehicle body and the propeller shroud, resulting in variable thrust on the vehicle.

9 Claims, 2 Drawing Sheets

THRUST ADJUSTMENT APPARATUS FOR AN UNDERWATER VEHICLE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to underwater vehicle propulsion systems and more particularly to an apparatus for providing thrust adjustment of an underwater vehicle independent of vehicle propulsion motor speeds.

(2) Description of the Prior Art

Numerous propulsion systems exist for underwater vehicles. A basic underwater vehicle propulsion system uses a motor to drive a shaft which, in turn, is connected to a propeller outside of the vehicle body. Adjustment of vehicle speed is dependent upon an adjustment of the motor speed. Unfortunately, many underwater vehicle propulsion system motors respond sluggishly to speed adjustment.

SUMMARY OF THE INVENTION

It is therefore an object of the present invention to provide a thrust adjustment apparatus on an underwater vehicle that is independent of vehicle propulsion motor speed.

Another object of the present invention is to provide a thrust adjustment apparatus on an underwater vehicle that rapidly responds to a request for thrust adjustment.

Other objects and advantages of the present invention will become more obvious hereinafter in the specification and drawings.

In accordance with the present invention, an apparatus is provided for adjusting the thrust of an underwater vehicle. A water passageway is formed by the vehicle body and a propeller shroud circumferentially deployed about the vehicle body. A vehicle propulsion system is operable within the water passageway. A circumferential channel is provided in the vehicle body forward of the propulsion system. A compliant surface covers the circumferential channel. A hydraulic pump system pumps water into the channel at a sufficient pressure to expand the compliant surface in response to a request for thrust adjustment. As the compliant surface expands, it increasingly chokes the water passageway, thereby decreasing the flow of water available to the propulsion system. The decreased flow of water causes the vehicle to decelerate. Conversely, when the hydraulic pump system pumps water out of the channel, the compliant surface contracts, thereby increasing the flow of water into the water passageway. The increased flow of water causes the vehicle to accelerate. Thus, thrust adjustment is achieved independent of the propulsion system's motor speed.

DESCRIPTION OF THE PREFERRED EMBODIMENT

Figure 1:
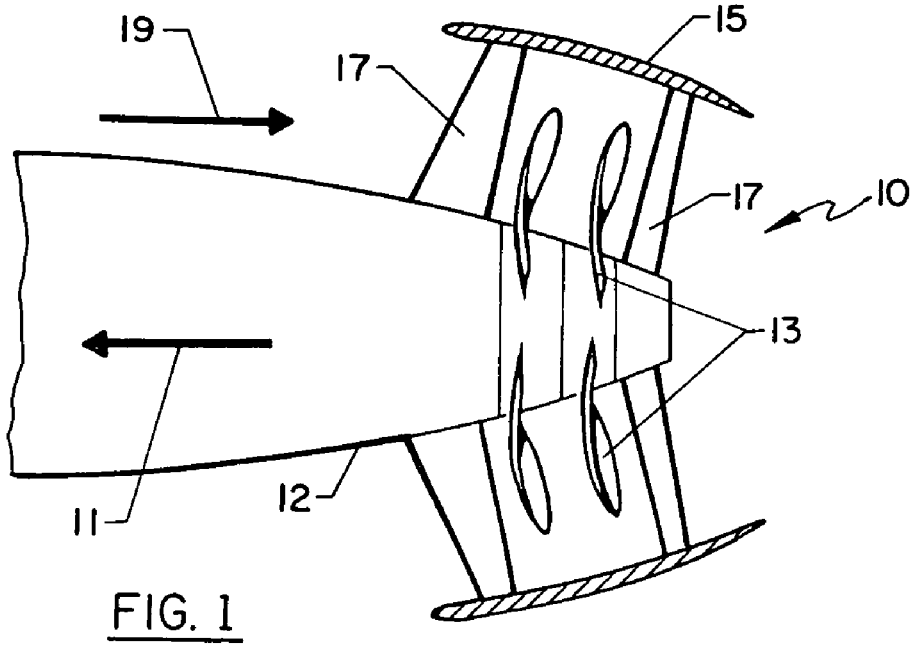
FIG. 1 is a cross-sectional, side-view of the aft end of an underwater vehicle.

Referring now to the drawings, and in particular to FIG. 1, a cross-sectional, side-view of the aft end of a typical underwater vehicle is shown and referenced generally by numeral 10. Vehicle 10 is propelled in the forward direction, indicated by arrow 11, by propellers 13 spinning about the vehicle body 12. Propellers 13 typically are encased within a shroud 15 having a diameter considerably larger than that of vehicle body 12. Shroud 15 circumferentially encases propellers 13 and is supported by a plurality of circumferentially spaced supports 17 attached to, and extending radially from vehicle body 12 at preselected spacing. Supports 17 are designed to produce minimal flow restriction. An annular passageway is thus formed between shroud 15 and vehicle body 12, such that a relative water flow, indicated by arrow 19, may flow to propellers 13. Thrust adjustment is achieved by decreasing the speed of the propellers 13 which, as mentioned above, is a function of the response time of the propeller's drive motor (not shown).

Figure 2:
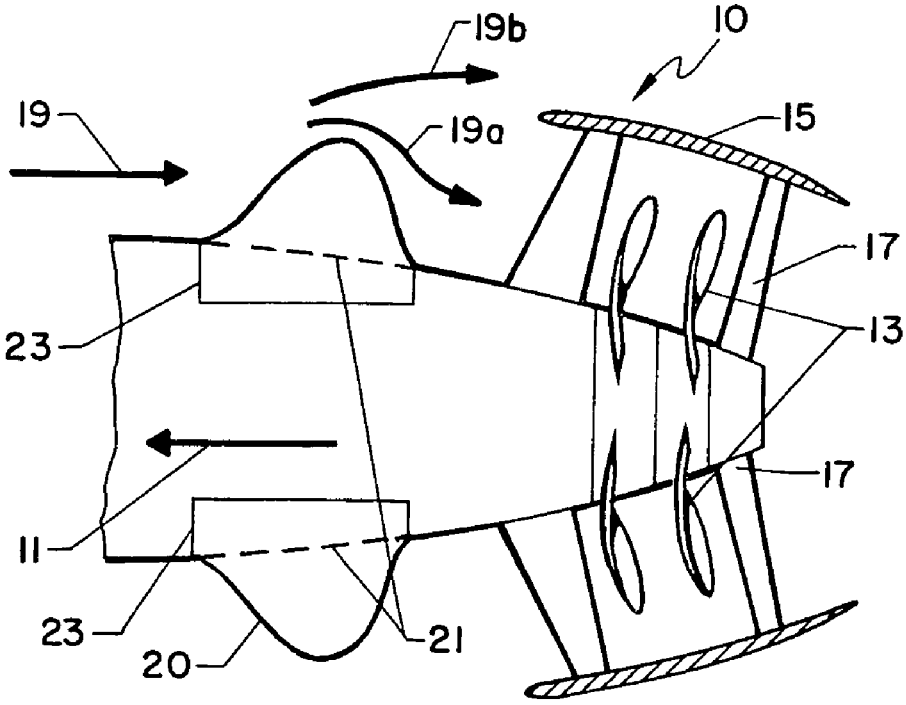
FIG. 2 is a cross-sectional, side-view of the aft end of an underwater vehicle equipped with the thrust adjustment apparatus according to the present invention.

In order to achieve thrust adjustment independent of and more quickly than the propeller's drive motor, the present invention makes use of a compliant surface 20 shown schematically in FIG. 2. Note that FIGS. 1 and 2 employ like reference numerals for common elements. Compliant surface 20, which extends in an annular fashion around the circumference of body 12, may be adjusted between its expanded position as shown and a neutral position as indicated by the dotted line referenced by numeral 21. In its expanded position, compliant surface 20 chokes the relative water flow 19 entering the passageway formed between shroud 15 and vehicle body 12. Accordingly, the water flow, indicated by arrow passageway 19*a*, entering the passageway between shroud 15 and vehicle body 12, is less than water flow 19. The remainder of water flow 19 passes outside of shroud 15 and is indicated by arrow shroud 19*b*. The reduced water flow entering passageway 19*a* made available to propellers 13 changes the thrust delivered to the vehicle 10 thereby causing vehicle 10 to decelerate.

In the preferred mode of operation, the compliant surface 20 would be nominally maintained to provide a half-choke position. This would allow quick speed changes of the vehicle 10, namely, deceleration upon further expansion of compliant surface 20 and acceleration upon contraction of compliant surface 20 toward the dotted line indicating neutral position 21. Expansion and contraction is achieved by constructing compliant surface 20 from a synthetic rubber such as neoprene. Any synthetic rubber will suffice as long as a continuously variable, smooth surface contour can be achieved during either expansion or contraction of compliant surface 20. A smooth surface contour equates to a smooth flow area to keep noise and flow losses at a minimum. Furthermore, specific surface contours may be achieved by varying the thickness of compliant surface 20.

Figure 3:
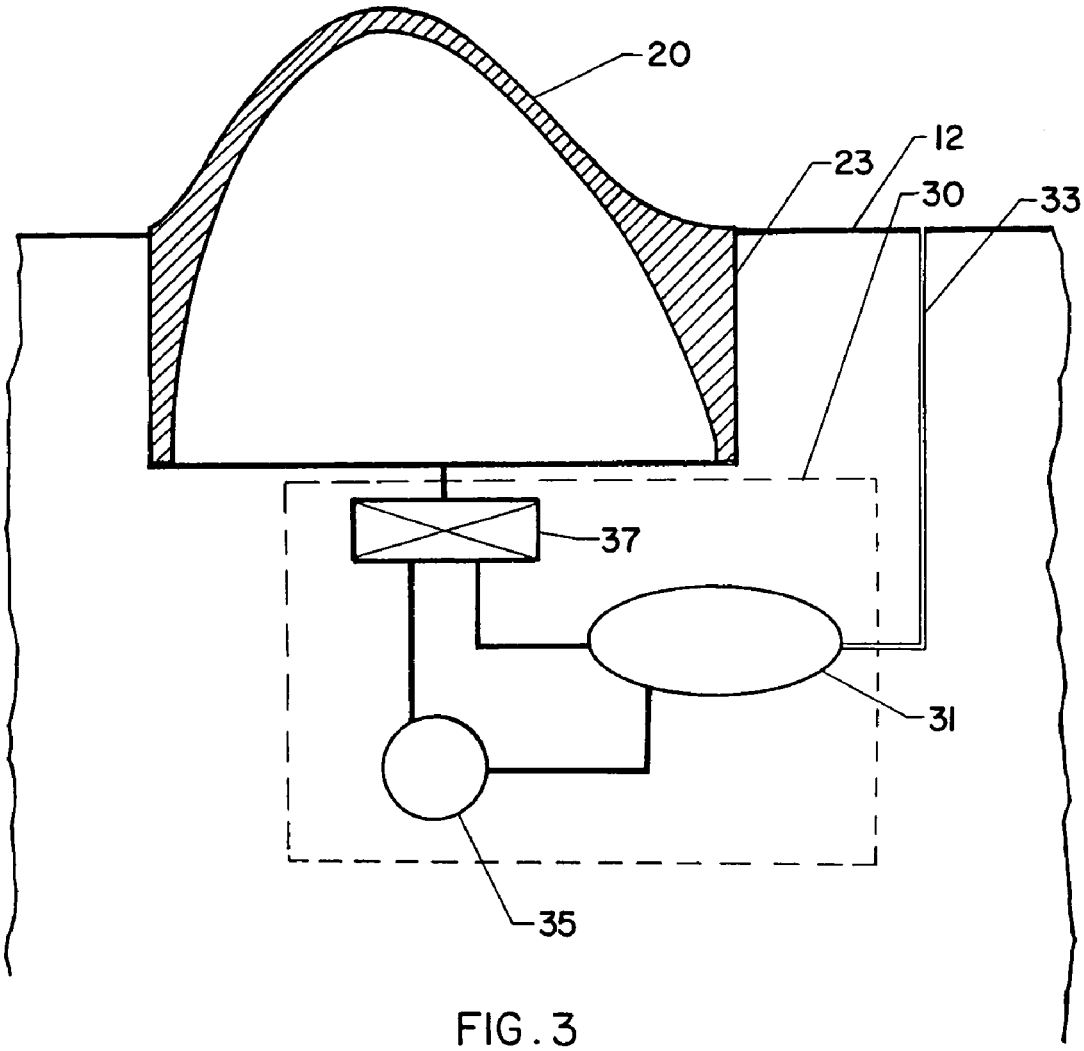
FIG. 3 is a detail, schematic view of the thrust adjustment apparatus according to the present invention.

To better understand the expansion and contraction of compliant surface 20, a detailed schematic view of the thrust adjustment apparatus is shown in FIG. 3. Once again, like elements between FIGS. 1, 2 and 3 will share common reference numerals. A channel 23 is cut into vehicle body 12. Channel 23 is provided circumferentially around vehicle body 12. Shown in its expanded state, compliant surface 20 covers, and is fixably attached to, channel 23 to form a smooth contour, continuously variable surface.

A hydraulic control system 30 is provided to pump water into channel 23 at sufficient pressure to expand compliant surface 20 in response to a request for thrust adjustment. Control system 30 consists of a pressure-referencing bladder 31 which is referenced to sea pressure outside the vehicle body 12 via seawater passage inlet 33. Referencing bladder 31 is, in turn, connected to a hydraulic pump 35 and control valve 37. Hydraulic pump 35 is then also connected to control valve 37. In this way, hydraulic pump 35 is continuously referenced or biased to the sea or depth pressure being exerted on the vehicle body 12. Control valve 37 permits water to pass into and out of channel 23.

When control system 30 receives a request for thrust adjustment, hydraulic pump 35 need only overcome the dynamic pressure head outside of the vehicle body 12, which is a function of the underwater vehicle speed. Since underwater vehicle speeds are relatively slow, hydraulic pump 35 can quickly and easily effect the expansion or contraction of compliant surface 20. The resulting thrust adjustment is independent of, and more quickly realized than, a propeller's drive motor speed adjustment.

The advantages of the present invention are numerous. By providing a continuously variable compliant surface forward of an underwater vehicle's propulsion system, thrust adjustment is achieved independent of the propulsion system's motor speed. Furthermore, by referencing the hydraulic pump to the underwater sea pressure being exerted on the vehicle body, thrust adjustment is quickly obtained as the hydraulic pump need only overcome a dynamic pressure head.

Thus, it is to be understood that many additional changes in the details, materials, steps and arrangement of parts, which have been herein described and illustrated in order to explain art within the principle and scope of the invention as expressed in the appended claims.

What is claimed is:

1. An apparatus for providing thrust adjustment on an underwater vehicle having an annular water passageway formed by the vehicle body and a propeller shroud, whereby the vehicle propulsion system is operable within the water passageway, comprising:

a circumferential portion of the vehicle body forming a compliant surface forward of the propulsion system with respect to a relative flow of water, said compliant surface following contours of said circumferential portion of the vehicle body in a neutral position, whereby in the neutral position thrust adjustment is entirely dependent upon the propulsion system; and means, within the vehicle body, for applying an expansion force to said compliant surface in the neutral position in response to a request for decreased thrust wherein said compliant surface expands to choke the relative flow of water through the water passageway and for applying a contraction force to said expanded compliant surface to increase the relative flow of water through the water passageway.

2. An apparatus as in claim 1 wherein said compliant surface is a synthetic rubber.

3. An apparatus as in claim 1 wherein said expansion and contraction force applying means comprises a hydraulic control system, said hydraulic control system including:

pump means for generating the expansion and contraction forces;

a control valve for adjusting an amount of expansion or contraction force being applied to said compliant surface.

4. An apparatus as in claim 3 wherein said pump means comprises:

a hydraulic pump; and a means for continually referencing said hydraulic pump to water pressure outside the vehicle body.

5. An apparatus for providing thrust adjustment on an underwater vehicle having a water passageway formed by the vehicle body and a propeller shroud, whereby the vehicle propulsion system is operable within said water passageway, comprising:

a compliant surface covering a circumferential channel in the vehicle body, said channel residing forward of the vehicle propulsion system; and a hydraulic pump system for pumping water into and out of said channel at a sufficient pressure to expand or contract said compliant surface in response to a request for thrust adjustment, wherein compliant surface increasingly chokes the water passageway as said compliant surface expands, and wherein said compliant surfaces permits an increased flow of water into the water passageway as said compliant surface contracts.

6. An apparatus as in claim 5 further comprising means for referencing said hydraulic pump system to water pressure outside the vehicle body whereby said hydraulic pump system need only overcome a dynamic pressure head outside the vehicle body.

7. An apparatus as in claim 5 wherein said compliant surface is a synthetic rubber having a relaxed position that follows contours of the vehicle body, wherein thrust adjustment is entirely dependent upon the propulsion system when said compliant surface is in said relaxed position.

8. An apparatus as in claim 5 wherein said compliant surface is a variable thickness compliant surface.

9. An apparatus as in claim 5 wherein said compliant surface forms a continuously variable vehicle body surface.

* * * * *